US006902381B2

(12) United States Patent
Hur et al.

(10) Patent No.: US 6,902,381 B2
(45) Date of Patent: Jun. 7, 2005

(54) CYLINDER HEAD FOR RECIPROCATING COMPRESSOR

(75) Inventors: Kyung-Bum Hur, Seoul (KR); Jung-Sik Park, Seoul (KR); Gye-Young Song, Changwon (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 10/297,183

(22) PCT Filed: May 24, 2001

(86) PCT No.: PCT/KR01/00869

§ 371 (c)(1),
(2), (4) Date: Dec. 3, 2002

(87) PCT Pub. No.: WO02/081911

PCT Pub. Date: Oct. 17, 2002

(65) Prior Publication Data

US 2004/0109777 A1 Jun. 10, 2004

(30) Foreign Application Priority Data

Apr. 3, 2001 (KR) ..... 2001-17678

(51) Int. Cl.[7] ..... F04B 53/10
(52) U.S. Cl. ..... 417/570
(58) Field of Search ..... 417/416, 417, 417/570

(56) References Cited

U.S. PATENT DOCUMENTS 1,462,695 A * 7/1923 Hanson et al. ..... 417/570
1,682,736 A * 9/1928 Berry ..... 417/570
1,951,215 A * 3/1934 Alexander ..... 417/570
3,058,649 A 10/1962 Plegat
3,374,944 A 3/1968 Scheldorf et al.
5,704,771 A * 1/1998 Fujisawa et al. ..... 417/417
6,202,791 B1 * 3/2001 Oh et al. ..... 417/417

FOREIGN PATENT DOCUMENTS

| | | | |
|---|---|---|---|
| EP | 0 745 773 | A1 | 12/1996 |
| FR | 764881 | A | 5/1934 |
| FR | 1430466 | A | 5/1966 |
| JP | 55-43230 | A | 3/1980 |
| JP | 11-22642 | A | 1/1999 |
| KR | 97-45541 | A | 7/1997 |

* cited by examiner

*Primary Examiner*—Michael Koczo, Jr.
(74) *Attorney, Agent, or Firm*—Birch, Stewart, Kolasch & Birch, LLP

(57) ABSTRACT

A cylinder head for reciprocating compressor comprises a frame including a insertion groove unit so as to make a concentric circle with a through hole penetrated in the body unit; a cylinder in which a cylinder body unit and a flange unit is coupled so as to be located at the through hole of the frame and the insertion groove unit respectively; a discharge cover in which the flange unit formed in the plenum unit is contacted on the step surface of the frame insertion groove; a plurality of volts connected to the step surface; and a valve body for switching the compressing space in the cylinder, thereby the assembling process of components can be simplified and productivity of the assembly can be simplified and productivity of the assembly can be increased by raising assembly accuracy.

14 Claims, 3 Drawing Sheets

BACK GROUND ART

CYLINDER HEAD FOR RECIPROCATING COMPRESSOR

This application is the national phase under 35 U.S.C. § 371 of PCT International Application No. PCT/KR01/00869 which has an International filing date of May 24, 2001, which designated the United States of America.

TECHNICAL FIELD

The present invention relates to a cylinder head for a reciprocating compressor, and in particular to a cylinder head for a reciprocating compressor which is capable of easily combining construction parts, precisely adjusting an assembly air gap, minimizing leakage of gas compressed in a cylinder and sufficiently cooling heat generated in a compression process.

BACKGROUND ART

Generally, a compressor is for compressing a fluid. The compressor can be divided into a rotation compressor, a reciprocating compressor and a scroll compressor, etc. according to fluid compression types. The compressor consists of a sealed container; a motor part installed inside the sealed container and generating a driving force; and a compression part receiving the driving force of the motor part and compressing gas.

In the compressor, when power is applied, the motor is operated and generates a driving force, the driving force is transmitted to the compression part, and accordingly the compression part sucks, compresses and discharges gas.

FIG. 1 is a longitudinal sectional view illustrating the compression part of the conventional compressor of the background art. As depicted in FIG. 1, the compression part of the compressor includes a frame 10 having a through hole 11; a cylinder 20 having an internal compression space 21 and combined with the through hole 11 of the frame 10; a piston 30 having a cylindrical shape, inserted into the compression space 21 and connected to the motor part; a discharge cover 40 for covering the compression space 21 of the cylinder 20; a discharge valve 50 inserted into the discharge cover 40 and opening/closing the compression space 21 of the cylinder 20 by a pressure difference; and a valve spring 51 inserted into the discharge cover 40 and supporting the discharge valve 50.

The discharge cover 40 and the cylinder 20 are combined with the frame 10 by plural bolts 60.

The frame 10 includes a body part 12 having a certain shape; a plate portion 13 extending from a certain side of the body part 12 so as to have a certain size; a through hole 11 formed at the body part 12; and a plurality of bolt or screw holes 14 formed at the plate portion 13.

The cylinder 20 includes a cylinder body 22 having an outer diameter corresponding to that of the through hole 11 of the frame 10 and a certain length; a flange portion 23 extending from the end of the cylinder body 22 so as to be at the same plane as that of the cylinder body 22 and having a certain thickness and width; a compression space 21 formed inside the cylinder body 22 so as to have a certain inner diameter; and a plurality of combining holes 24 formed at the flange portion 23.

The discharge cover 40 includes a plenum portion 41 having a cap shape to have a certain inner space; a flange portion 42 radially extending from the plenum portion 41 so as to have a certain width; a discharge hole 43 formed at a certain side of the plenum portion 41; and plural combining holes 44 formed at the flange portion 42.

A discharge pipe (not shown) for discharging gas is combined with the discharge hole 43 of the discharge cover 40.

First, the body 22 of the cylinder 20 is inserted into the through hole 11 of the frame 10, the flange portion 23 of the cylinder 20 contacts to a certain surface of the plate portion 13 of the frame 10, and accordingly the cylinder 20 is combined with the frame 10.

And, when the discharge valve 50 and the valve spring 51 are inserted into the inner space of the plenum portion 41 of the discharge cover 40, to make the discharge cover 40 cover the compression space 21 of the cylinder 20, the flange portion 42 of the discharge cover 40 is contacted to the flange portion 23 of the cylinder 20.

Herein, the discharge valve 50 placed inside the discharge cover 40 blocks the compression space 21 of the cylinder 20 by being elastically supported by the valve spring 51.

And, the combining hole 24 of the cylinder 20 and the combining hole 44 of the discharge cover 40 respectively coincide with the screw hole 14 of the frame 10, the bolt 60 is respectively fastened to the coincided screw hole 14 and the combining holes 24, 44, and accordingly the cylinder 20 and the discharge cover 40 are fixedly combined with the frame 10.

The operation of the compression part of the conventional compressor will be described.

First, when the driving force of the motor part is transmitted to the piston 30, the piston 30 performs a linear reciprocating motion in the compression space 21 of the cylinder 20.

According to the linear reciprocating motion of the piston 30, the discharge valve 50 sucks, compresses and discharges gas by opening/closing the compression space 21 of the cylinder 20.

The high temperature-high pressure gas discharged from the compression space 21 of the cylinder 20 passes the inner space of the plenum portion 41 of the discharge cover 50 and is discharged to the outside through the discharge hole 43 and the discharge pipe combined with the discharge hole 43.

However, in the compression part of the conventional compressor, in combining of the cylinder 20 and the discharge cover 40 with the frame 10, because the combining hole 24 of the cylinder 20 and the combining hole 44 of the discharge cover 40 are respectively combined with the screw hole 14 of the frame 10 by the bolts 60, the assembly process of those parts are intricate. In addition, it is difficult to coincide the center of the compression space 21 of the cylinder 20 with the inner space center of the plenum portion 41 of the discharge cover 40.

And, due to a fabrication error in surface-processing of the flange portion 42 of the discharge cover 40 and the flange portion 23 of the cylinder 20, a gap may occur between the flange portion 42 of the discharge cover 40 and the flange portion 23 of the cylinder 20, in that case, the high temperature-high pressure gas discharged from the compression space 21 of the cylinder 20 may leak through the gap between the flange portion 42 of the discharge cover 40 and the flange portion 23 of the cylinder 20.

And, while compressing and discharging the gas in the compression space 21 of the cylinder 20, because high temperature heat generated at the discharge side of the cylinder 20 can not be sufficiently cooled, construction parts may be deformed.

SUMMARY OF THE INVENTION

In order to solve the above-described problems, it is an object of the present invention to provide a cylinder head for a reciprocating compressor which is capable of easily combining a cylinder with a discharge cover and precisely adjusting an assembly air gap.

It is another object of the present invention to provide a cylinder head for a reciprocating compressor which is capable of minimizing leakage of gas compressed in a cylinder and sufficiently cooling heat generated in a compression process.

In order to achieve the above-mentioned objects, a cylinder head for a reciprocating compressor comprises a cylinder including a ring-shaped protrusion formed at a certain side of a cylinder body having an internal compression space so as to have a certain width and a height; a discharge cover including an inner space having an inner diameter corresponded to an outer diameter of the ring-shaped protrusion and covering the compression space of the cylinder by combining the inner space with the ring-shaped protrusion of the cylinder; and a valve body inserted into the inner space of the discharge cover and opening/closing the compression space of the cylinder.

A cylinder head for a reciprocating compressor comprises a frame including a through hole formed at a certain-shaped frame body and an insertion groove having a certain diameter and a depth so as to be a concentric circle with the through hole; a cylinder including a flange portion formed at a certain end of a cylinder body having an internal compression space so as to have a certain area, wherein the cylinder body and the flange portion respectively combine with the through hole and the insertion groove of the frame; a discharge cover including a flange portion curved-extended from a cap-shaped plenum portion having a certain inner space so as to have a size corresponded to the inner diameter of the insertion groove of the frame and covering the compression space of the cylinder by inserting the flange portion into the insertion groove of the frame; and a valve body inserted into the plenum portion of the discharge cover and opening/closing the compression space of the cylinder.

A cylinder head for a reciprocating compressor comprises a frame including a plate portion extended from a certain-shaped frame body so as to have a certain size, a through hole formed at the body and an insertion groove formed at a certain side of the body so as to be a concentric circle of the through hole; a cylinder including a flange portion formed at a certain end of a cylinder body having an internal compression space, a ring-shaped protrusion formed at a certain side of the cylinder body so as to have a certain width and a height, wherein the cylinder body and the flange portion respectively combine with the through hole and the insertion groove of the frame; a discharge cover including a cap-shaped plenum portion having an inner diameter corresponded to an outer diameter of the ring-shaped protrusion, a flange portion curved-extended from the end of the plenum portion so as to have a certain size, wherein the inner diameter of the flange portion is inserted into the ring-shaped protrusion and the flange portion contacts to a step surface of the insertion groove of the frame; plural bolts for combining the flange portion of the discharge cover with the frame body; and a valve body inserted into the plenum portion of the discharge cover and opening/closing the compression space of the cylinder.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the preferred embodiments of the present invention will be described with reference to accompanying drawings.

Figure 1:
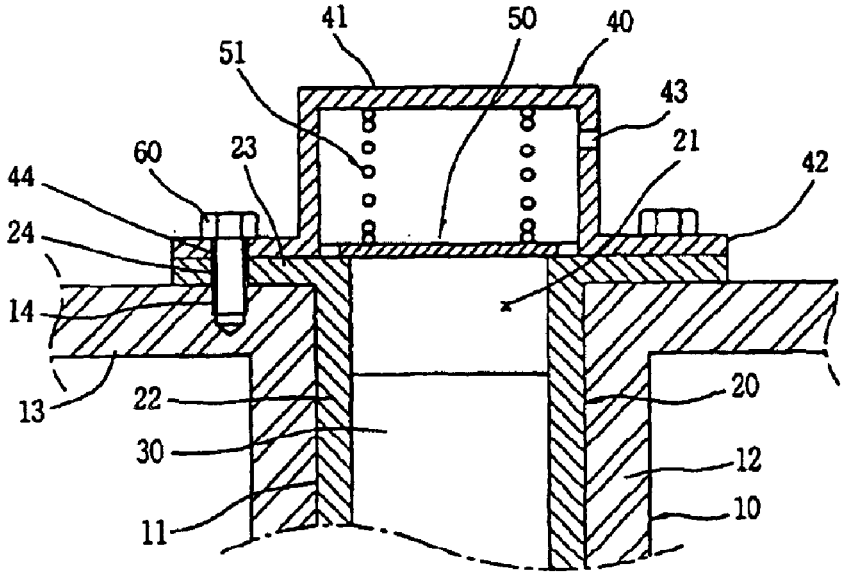
FIG. 1 is a longitudinal sectional view illustrating a compression part of the conventional compressor.
Figure 2:
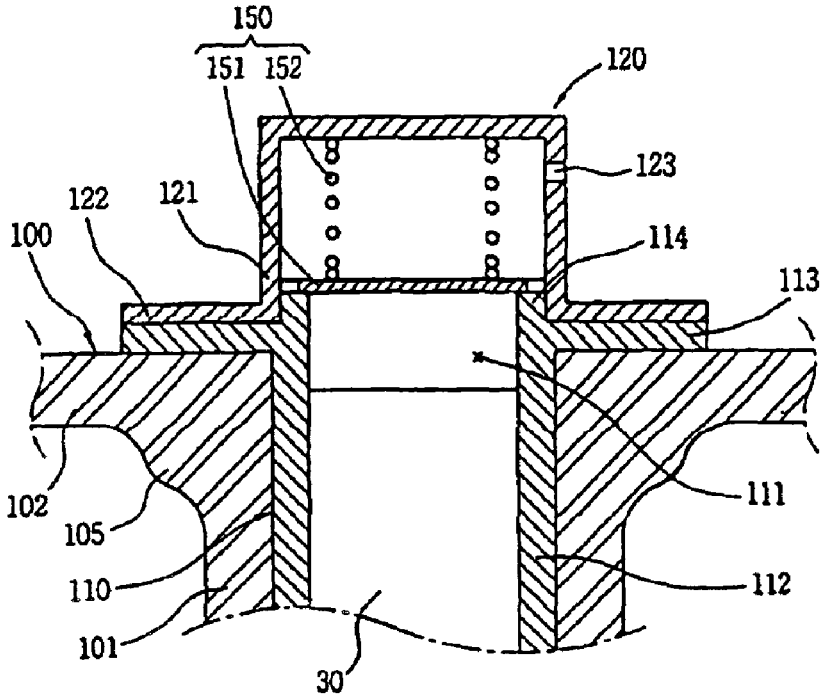
FIG. 2 is a longitudinal sectional view illustrating an embodiment of a cylinder head for a reciprocating compressor in accordance with the present invention.

FIG. 2 is a longitudinal sectional view illustrating an embodiment of a cylinder head for a reciprocating compressor in accordance with the present invention. As depicted in FIG. 2, the embodiment of the cylinder head for the reciprocating compressor in accordance with the present invention includes a cylinder 110 having a flange portion 113 extended from the end of a cylinder body 112 having an inner compression space 11 to have a certain area and a ring-shaped protrusion portion 114 at a certain side of the cylinder body 112 so as to have a certain width and a height; a discharge cover 120 having a cap-shaped plenum portion 121 having the inner diameter corresponded to the outer diameter of the protrusion portion 114, a flange portion 122 curved-extended so to have a certain area and covering the inner space of the cylinder 110 by combining the inner diameter of the plenum portion 121 with the protrusion portion 114 of the cylinder 110; and a valve body 150 inserted into the plenum portion 121 of the discharge cover 120 and opening/closing the compression space 111 of the cylinder 110.

The compression space 111 of the cylinder 110 consists of a through hole having a certain inner diameter to receive the cylindrical piston 30, outer diameters of the compression space 111 and the protrusion portion 114 are concentric circles.

The inner circumferences of the protrusion portion 114 and the compression space 111 are concentric circles. In a modified embodiment, the inner circumference of the protrusion portion may not coincide with that of the compression space.

And, a reinforcing rib 105 for reinforcing strength is formed at a portion at which the body 101 meets the plate portion 102 of the frame 100.

The plenum portion 121 of the discharge cover 120 has a circular inner space having a certain open side, the inner diameter of the inner space is the same as the outer diameter of the protrusion portion 114 of the cylinder 110, and a discharge hole 123 is formed at a certain side of the plenum portion 121.

The valve body 150 consists of a discharge valve 151 for opening/closing the compression space 111 of the cylinder 110 and a valve spring 152 for elastically supporting the discharge valve 151.

The cylinder 110 and the discharge cover 120 are fixedly combined with the frame 100 by fastening means (not shown), and a piston 30 connected to the motion part is inserted into the compression space 111 of the cylinder 110. The fastening means can be welding or bolting, etc.

Figure 3:
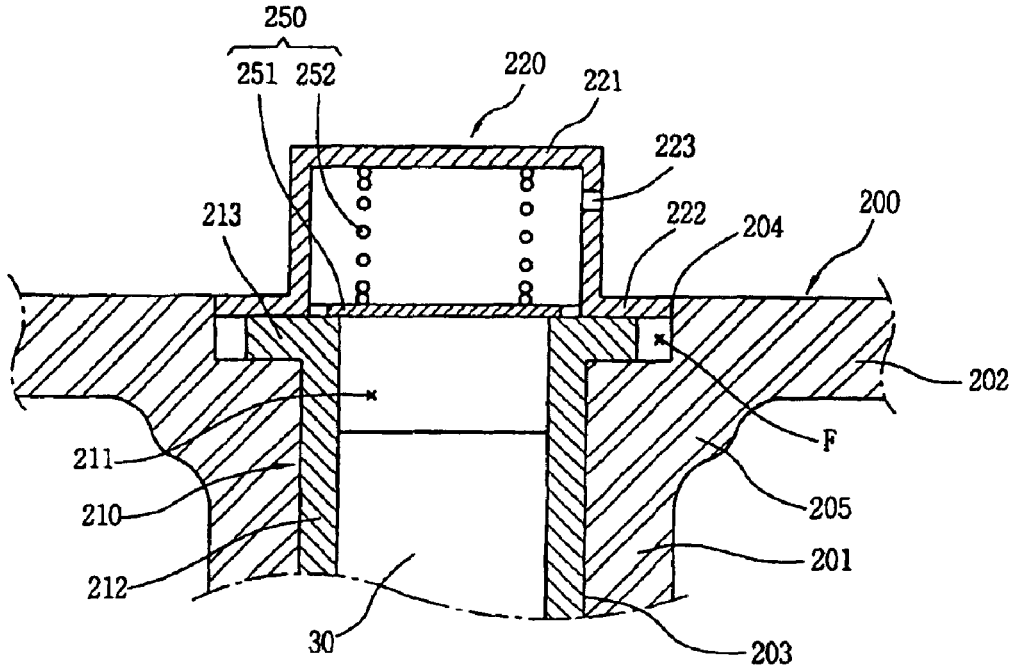
FIG. 3 is a longitudinal sectional view illustrating another embodiment of a cylinder head for a reciprocating compressor in accordance with the present invention.

In addition, as depicted in FIG. 3, another embodiment of the cylinder head of the compressor in accordance with the present invention includes a frame 200 having a plate portion 202 extended from a certain end of a body 201 so as to have a certain area, a through hole 203 formed at the body 201 and an insertion groove 204 having a certain diameter and a depth to be a concentric circle of the through hole 203; a cylinder 210 including a flange portion 213 formed at a certain end of a cylinder body 212 having an inner compression space 211 so as to have a certain area, wherein the cylinder body 221 and the flange portion 213 respectively contact the through hole 203 and the insertion groove 204 of the frame 200; a discharge cover 220 including a flange portion 222 radially extending from a cap-shaped plenum portion 221 having a certain inner space so as to have a size corresponded to the inner diameter of the insertion groove 204 of the frame 200 and covering the compression space 211 of the cylinder 210 by inserting the flange portion 222 into the insertion groove 204 of the frame 200; and a valve body 250 inserted into the plenum portion 221 of the discharge cover 220 and opening/closing the compression space 211 of the cylinder 210.

The plate portion 202 of the frame 200 has the same plane as a certain plane of the frame body 201, the inner diameter of the frame insertion groove 204 is greater than that of the through hole 203, and the frame insertion groove 204 is formed at a certain side of the frame body 201 at which the plate portion 202 is formed.

A reinforcing rib 205 for reinforcing strength is formed at a portion at which the body 201 meets the plate portion 202 of the frame 200.

The outer diameter of the body 212 of the cylinder 210 is the same as the inner diameter of the through hole 203 of the frame 200.

The outer diameter of the cylinder flange portion 213 is smaller than the inner diameter of the insertion groove 204, and an oil flow channel (F) is formed by the outer circumference of the cylinder flange portion 213, the inner circumference of the insertion groove 204, the bottom surface of the insertion groove 204 and the flange portion 222 of the discharge cover 220.

The inner diameter of the inner space of the plenum portion 221 and the outer diameter of the flange portion 222 are concentric circles. A discharge hole 223 for discharging gas is formed at a certain side of the plenum portion 221 of the discharge cover 220. The valve body 250 inserted into the plenum portion 221 includes a discharge valve 251 for opening/closing the compression space 211 of the cylinder 210 and a valve spring 252 for elastically supporting the discharge valve 251.

It is preferable for the cylinder 210 and the discharge cover 220 to be fixedly combined with each other by welding the flange portion 222 and the frame 200.

A piston 30 connected to the motor part is inserted into the compression space 211 of the cylinder 210.

Figure 4:
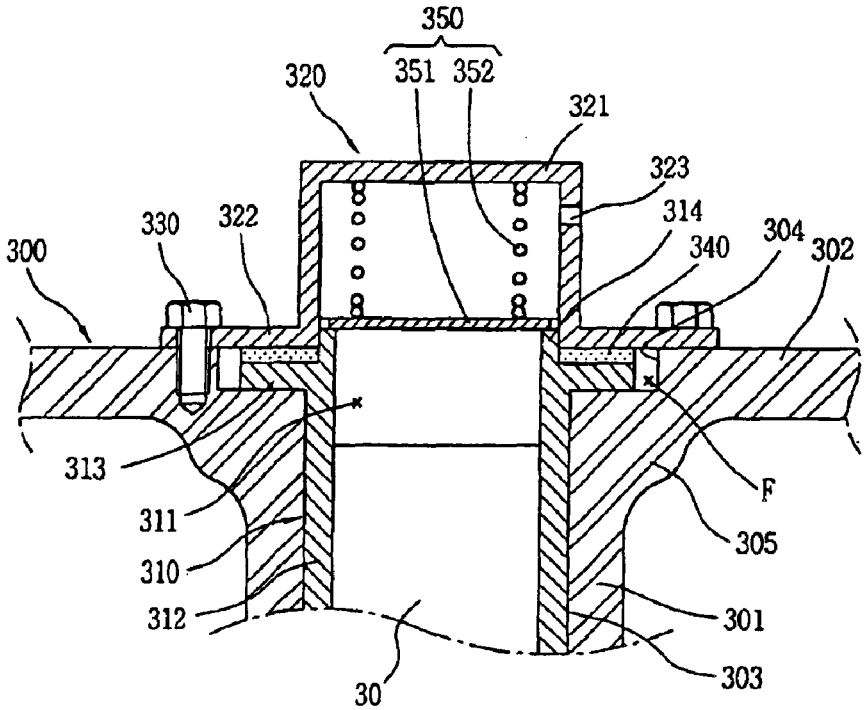
FIG. 4 is a longitudinal sectional view illustrating yet another embodiment of a cylinder head for a reciprocating compressor in accordance with the present invention.

In addition, as depicted in FIG. 4, yet another embodiment of the cylinder head of the compressor in accordance with the present invention includes a frame 300 having a plate portion 302 extended from a body 301 so as to have a certain size, a through hole 303 formed at the body 301 and an insertion groove 304 formed at a certain surface of the body 301 so as to be a concentric circle of the through hole 303; a cylinder 310 having a flange portion 313 formed at a certain end of a cylinder body 312 having an internal compression space 311, a ring-shaped protrusion 314 formed at a certain side of the cylinder body 312 so as to have a certain width and a height, wherein the cylinder body 312 and the flange portion 313 respectively contact the through hole 303 and the insertion groove 304 of the frame 300; a discharge cover 320 including a cap-shaped plenum portion 321 having an inner diameter corresponded to an outer diameter of the ring-shaped protrusion 314, a flange portion 322 radially extending from the end of the plenum portion 321 so as to have a certain size, wherein the outer diameter of the ring-shaped protrusion 314 is inserted into the inner diameter of the flange portion 322 and the flange portion 322 is in contact with a step surface of the frame insertion groove 304, namely, a certain side of the frame body 301; plural bolts 330 for fastening the flange portion 322 of the discharge cover 320 with the body 301 of the frame 300; and a valve body 350 inserted into the plenum portion 321 of the discharge cover 320 and opening/closing the compression space 311 of the cylinder 310.

The plate portion 302 of the frame 300 is formed at a certain side of the frame body 301 so as to have the same plane, the insertion groove 304 has an inner diameter and a depth greater than those of the through hole 303 so as to be a concentric circle of the through hole 303 of the body 301.

The inner circumference of the ring-shaped protrusion 314 of the cylinder 310 has the same plane as the inner circumference of the compression space 311.

The outer diameter of the body 312 of the cylinder 310 is the same as the inner diameter of the through hole 303 of the frame 300.

The outer diameter of the flange portion 313 is smaller than the inner diameter of the insertion groove 304, and an oil flow channel (F) is formed by the outer circumference of the flange portion 313, the inner circumference of the insertion groove 304, the bottom surface of the insertion groove 304 and the flange portion 322 of the discharge cover 320.

A sealing member 340 is placed between the flange portion 313 of the cylinder 310 and the flange portion 322 of the discharge cover 320. The sealing member 340 has a certain thickness and a ring shape same as the shape of the cylinder flange portion 313, and it is preferable for the sealing member 340 to be made of elastic materials.

Because an added thickness of the flange portion 313 and the sealing member 340 is greater than a depth of the insertion groove 304, the sealing member is pressed by fastening of the bolt 330, and accordingly sealing is performed.

A reinforcing rib 305 is formed at a surface of the frame 300 at which the body 301 of the frame 300 meets the flange portion 302 to reinforce strength by fastening of the bolt 330.

In FIG. 4, unexplained reference numeral 351 is a discharge valve, and 352 is a valve spring.

Figure 5:
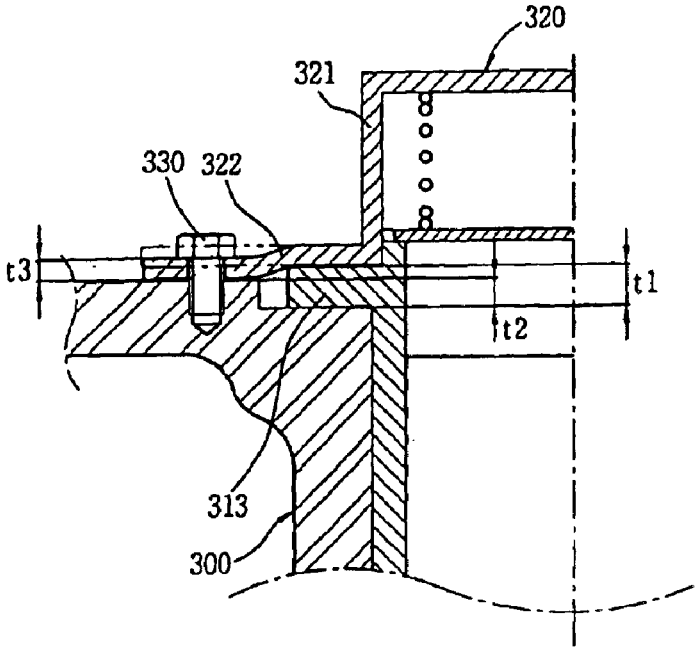
FIG. 5 is a longitudinal sectional view illustrating a modified embodiment of a cylinder head for a reciprocating compressor in accordance with the present invention.

As depicted in FIG. 5, in a modified example of the sealing structure, because a thickness t1 of the flange portion 313 of the cylinder 310 is greater than a depth t2 of the insertion groove 304 of the frame 300, when the discharge cover 320 is combined with the frame 300 by the bolt 330, the flange portion 322 of the discharge cover 320 is elastically deformed.

Because the flange portion 322 of the discharge cover 320 is combined as elastically deformed, sealing is performed between the flange portion 322 and the frame 300 as well as between the flange portion 322 of the discharge cover 320 and the flange portion 313 of the cylinder 310. Accordingly, it is possible not to use the sealing member.

It is preferable for the flange portion 322 of the discharge cover 320 to have a thickness t3 in the range of 2 mm~4 mm.

The discharge cover 320 is made of steel. And, when the thickness t3 of the flange portion 322 is in the range of 2 mm~4 mm and the flange portion 322 is combined with the frame 300 by the bolt 330, the flange portion 32 is elastically deformed without causing deformation of the frame 300, and accordingly it can perform a sealing function.

Figure 6:
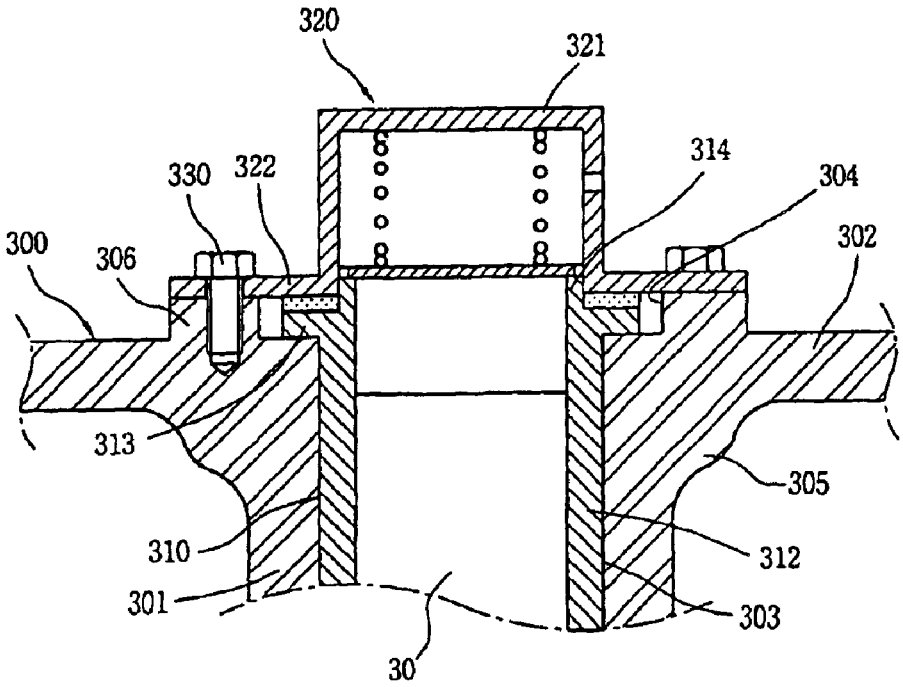
FIG. 6 is a longitudinal sectional view illustrating a modified embodiment of a cylinder head for a reciprocating compressor in accordance with the present invention.

As depicted in FIG. 6, as a modified example of the frame 300, the plate portion 302 having a certain size is formed at a certain side of the body 301, the through hole 303 is formed at the body 301, and the ring-shaped protrusion 306 having a certain width and a height is formed at a certain side of the body 301.

The plate portion 302 of the frame 300 has the same plane as the certain side of the body 301, the ring-shaped protrusion 306 is formed at a certain side of the body 301 on which the plate portion 302 is formed, the insertion groove 304 having a certain diameter and a depth is formed by the ring-shaped protrusion portion 306, and the inner diameter of the insertion groove 304 is a concentric circle of the through hole 303.

And, a reinforcing rib 305 for reinforcing strength is formed at a portion at which the body 301 meets the plate portion 302 of the frame 300.

And, combining the cylinder 310 with the discharge cover 320 by the bolt 330 is the same as the above-described embodiment. In more detail, the body 312 and the flange portion 313 of the cylinder 310 are respectively inserted into the through hole 303 and the insertion groove 304 of the frame 300, and accordingly the cylinder 310 is combined with the frame 300.

And, the outer diameter of the ring-shared protrusion 314 of the cylinder 310 is inserted into the inner diameter of the plenum portion 321 of the discharge cover 320, the flange portion 322 is contacted to the upper surface of the protrusion 306 of the frame 300, and the flange portion 322 of the discharge cover 320 is combined with the protrusion 306 of the frame 300 by the plural bolts 330.

Hereinafter, advantages of the cylinder head for the reciprocating compressor in accordance with the present invention will be described.

First, the driving force of the motor part is transmitted to the piston 30, the piston 30 performs a linear reciprocating motion in the compression space 111, 211, 311 of the cylinder, simultaneously the valve body 150, 250, 350 opens/closes the compression space 111, 211, 311, and accordingly gas is sucked, compressed and discharged.

The high temperature-high pressure gas discharged from the compression space 111, 211, 311 of the cylinder passes the internal space of the plenum portion 121, 221, 321 of the discharge cover and is discharged to the outside through the discharge hole 123, 223, 323.

And, during that process, high-temperature heat is generated at the end of the discharge side of the cylinder 110, 210, 310.

In the embodiment of the present invention, the protrusion 114 of the cylinder 110 is the concentric circle of the compression space 111 of the cylinder 110, when the cylinder 110 is combined with the frame 100, because the inner diameter of the plenum portion 121 of the discharge cover 120 is inserted into the protrusion 114 of the cylinder 110, the compression space 111 of the cylinder 110 coincides with the internal space of the plenum portion 121 of the discharge cover 120, and accordingly an assembly accuracy can be improved and an assembly can be facilitated.

And, because the compression space 111 of the cylinder 110 precisely coincides with the internal space of the plenum portion 121 of the discharge cover 120, the valve body 150 placed inside the internal space of the plenum portion 121 of the discharge cover 120 can accurately open/close the compression space 111 in the operation.

In addition, because the inner circumference of the plenum portion 121 of the discharge cover 120 contacts to the outer circumference of the protrusion 114 of the cylinder 110 and simultaneously the flange portion 113 of the cylinder 110 contacts to the flange portion 122 of the discharge cover 120, leakage of the high temperature-high pressure gas discharged from the compression space 111 of the cylinder 110 can be minimized.

In the another embodiment of the present invention, the inner diameter of the insertion groove 204 of the frame 200 is the same as the outer diameter of the flange portion 222 of the discharge cover 220, the through hole 203 of the frame 200 is the concentric circle of the inner diameter of the insertion groove 204, and the outer diameter of the flange portion 222 of the discharge cover 220 is the concentric circle of the inner diameter of the internal space of the plenum portion 221. When the cylinder 210 is inserted into the through hole 203 of the frame 200, the compression space 211 of the cylinder 210 coincides with the internal space of the plenum portion 221 of the discharge cover 220, and accordingly it is possible to improve an assembly accuracy and facilitate an assembly.

In addition, the flange portion 213 of the cylinder 210 contacts to the flange portion 222 of the discharge cover 220, the outer circumference of the flange portion 222 contacts to the inner circumference of the insertion groove 204 of the frame 200, it is possible to minimize leakage of high temperature-high pressure gas discharged from the compression space 211 of the cylinder 210 to the outside.

In addition, an oil flow channel (F) is formed between the outer circumference of the flange portion 213 of the cylinder 210, the internal surface of the insertion groove 204 and the flange portion 222 of the discharge cover 220, and accordingly heat generated at the discharge side of the cylinder 210 can be cooled by oil flowing in the oil flow channel (F).

In the yet another embodiment of the present invention, the protrusion 314 of the cylinder 310 is the concentric circle of the compressions space 311 of the cylinder 310, when the cylinder 310 is inserted into the through hole 303 of the frame 300, the outer diameter of the ring-shaped protrusion 314 of the cylinder 310 is inserted into the inner diameter of the plenum portion 321 of the discharge cover 320, the compression space 311 of the cylinder 310 coincides with the internal space of the plenum portion 321 of the discharge cover 320, and accordingly it is possible to improve an assembly accuracy and facilitate an assembly.

In addition, the inner circumference of the plenum portion 321 of the discharge cover 320 contacts to the outer circumference of the protrusion 314 of the cylinder 310, the flange portion 313 of the cylinder 310 contacts to the flange portion 322 of the discharge cover 320, and accordingly it is possible to minimize leakage of high temperature-high pressure gas discharged from the compression space 211 of the cylinder 210 to the outside.

An oil flow channel (F) is formed between the outer circumference of the flange portion 313 of the cylinder 310, the internal surface of the insertion groove 304 of the frame 300 and the flange portion 322 of the discharge cover 320, heat generated at the discharge side of the compression space 311 of the cylinder 310 can be cooled by oil flowing in the oil flow channel (F).

And, when the sealing member 340 is inserted between the flange portion 322 of the discharge cover 320 and the flange portion 313 of the cylinder 310, it is possible to minimize leakage of gas and oil.

In addition, when the flange portion 322 of the discharge cover 320 performs the sealing function by being elastically deformed, contact force is strengthened, and accordingly it is possible to minimize leakage of gas and oil.

INDUSTRIAL APPLICABILITY

As described above, in the cylinder head of the reciprocating compressor in accordance with the present invention, by facilitating and simplifying an assembly process of construction parts and bettering assembly accuracy, assembly productivity can be improved. In addition, by minimizing leakage of high temperature-high pressure gas discharged from a compression space of a cylinder to the outside, gas compression performance can be improved.

In addition, in compressing and discharging of gas in the compression space of the cylinder, by sufficiently cooling high temperature heat generated in the discharge side of the cylinder, deformation and damage of construction parts can be prevented, and accordingly reliability of a product can be improved.

What is claimed is:

1. A cylinder head for a reciprocating compressor, comprising:

a frame including a plate portion extending from a frame body so as to have a predetermined size, a through hole formed at the body and an insertion groove formed at one side of the body so as to form a concentric circle with the through hole;

a cylinder including a flange portion formed at an end of a cylinder body having an internal compression space, a ring-shaped protrusion formed at a side of the cylinder body so as to have a predetermined width and a height, wherein the cylinder body and the flange portion respectively contact the through hole and the insertion groove of the frame;

a discharge cover including a cap-shaped plenum portion having an inner diameter corresponded to an outer diameter of the ring-shaped protrusion, a flange portion radially extending from an end of the plenum portion so as to have a predetermined size, wherein the outer diameter of the ring-shaped protrusion is inserted into the inner diameter of the flange portion and the flange portion contacts a stepped surface of the insertion groove of the frame;

a plurality of bolts for combining the flange portion of the discharge cover with the frame body; and a valve body inserted into the plenum portion of the discharge cover and opening/closing the compression space of the cylinder.

2. The cylinder head according to claim 1, wherein the outer diameter of the flange portion of the cylinder is smaller than the inner diameter of the insertion groove of the frame, and an oil flow channel is formed between the outer circumference of the flange portion of the cylinder and the inner circumference of the insertion groove of the frame.

3. The cylinder head according to claim 1, wherein a sealing member is inserted between the flange portion of the cylinder and the flange portion of the discharge cover.

4. The cylinder head according to claim 3, wherein an added thickness of the flange portion and the sealing member is greater than a depth of the insertion groove, and sealing is performed by pressing the sealing member by fastening the bolts.

5. The cylinder head according to claim 1, wherein a thickness of the flange portion of the cylinder is greater than a depth of the insertion groove of the frame, the flange portion of the discharge cover is elastically deformed by fastening the bolts, and sealing is performed between the flange portion of the discharge cover and the step surface of the frame as well as the flange portion of the discharge cover and the flange portion of the cylinder.

6. The cylinder head according to claim 5, wherein the flange portion of the discharge cover has a thickness in the range of 2 to 4 mm.

7. The compressor according to claim 5, wherein the flange portion of the discharge cover has a thickness in the range of 2 to 4 mm.

8. The cylinder head according to claim 1, wherein a reinforcing rib is formed at a surface of the frame at which the body meets the flange portion of the frame to reinforce the bolt fastening strength.

9. A compressor comprising:

a piston; and a cylinder head, wherein said cylinder head further includes a frame including a plate portion extending from a frame body so as to have a predetermined size, a through hole formed at the body and an insertion groove formed at one side of the body so as to form a concentric circle with the through hole;

a cylinder cooperatively enclosing said reciprocating piston and including a flange portion formed at an end of a cylinder body having an internal compression space, a ring-shaped protrusion formed at a side of the cylinder body so as to have a predetermined width and a height, wherein the cylinder body and the flange portion respectively contact the through hole and the insertion groove of the frame;

a discharge cover including a cap-shaped plenum portion having an inner diameter corresponded to an outer diameter of the ring-shaped protrusion, a flange portion radially extending from an end of the plenum portion so as to have a predetermined size, wherein the outer diameter of the ring-shaped protrusion is inserted into the inner diameter of the flange portion and the flange portion contacts a stepped surface of the insertion groove of the frame;

a plurality of bolts for combining the flange portion of the discharge cover with the frame body; and a valve body inserted into the plenum portion of the discharge cover for opening and closing the compression space of the cylinder.

10. The compressor according to claim 9, wherein the outer diameter of the flange portion of the cylinder is smaller than the inner diameter of the insertion groove of the frame, and an oil flow channel is formed between the outer circumference of the flange portion of the cylinder and the inner circumference of the insertion groove of the frame.

11. The compressor according to claim 9, wherein a sealing member is inserted between the flange portion of the cylinder and the flange portion of the discharge cover.

12. The compressor according to claim 11, wherein an added thickness of the flange portion and the sealing member is greater than a depth of the insertion groove, and sealing is performed by pressing the sealing member by fastening the bolts.

13. The compressor according to claim 9, wherein a thickness of the flange portion of the cylinder is greater than a depth of the insertion groove of the frame, the flange portion of the discharge cover is elastically deformed by fastening the bolts, and sealing is performed between the flange portion of the discharge cover and the step surface of the frame as well as the flange portion of the discharge cover and the flange portion of the cylinder.

14. The compressor according to claim 9, wherein the compressor is a reciprocating compressor.

* * * * *